US008662188B2

(12) United States Patent
Chaize et al.

(10) Patent No.: US 8,662,188 B2
(45) Date of Patent: Mar. 4, 2014

(54) WIRED DRILL PIPE CABLE CONNECTOR SYSTEM

(75) Inventors: Eric Chaize, Barro-in-Furness (GB); Joseph A. Nicholson, Broughton-Furness Cumbria (GB); Jonathan W. Brown, Noisy le Roi (FR); Laurent Caekebeke, Rue des Anges (FR)

(73) Assignee: Intelliserv, LLC, Houston, TX (US)

( * ) Notice: Subject to any disclaimer, the term of this patent is extended or adjusted under 35 U.S.C. 154(b) by 465 days.

(21) Appl. No.: 12/936,667

(22) PCT Filed: Mar. 25, 2009

(86) PCT No.: PCT/IB2009/006535
§ 371 (c)(1),
(2), (4) Date: Dec. 30, 2010

(87) PCT Pub. No.: WO2009/133474
PCT Pub. Date: Nov. 5, 2009

(65) Prior Publication Data

US 2011/0108267 A1 May 12, 2011

Related U.S. Application Data

(60) Provisional application No. 61/043,258, filed on Apr. 8, 2008.

(51) Int. Cl.
*E21B 19/16* (2006.01)

(52) U.S. Cl.
USPC ..... 166/380; 166/65.1

(58) Field of Classification Search
USPC ..... 166/65.1, 380; 175/40; 439/578, 439/581–585; 340/855.1, 855.2, 854.4, 340/854.9
See application file for complete search history.

(56) References Cited

U.S. PATENT DOCUMENTS

| | | | | |
|---|---|---|---|---|
| 3,079,793 | A | 3/1963 | LeBus et al. | |
| 3,472,076 | A | 10/1969 | Howell et al. | |
| 4,553,806 | A * | 11/1985 | Forney et al. | 439/277 |
| 4,605,268 | A | 8/1986 | Meador | |
| 5,073,129 | A * | 12/1991 | Szegda | 439/585 |
| 5,531,545 | A | 7/1996 | Seegmiller et al. | |
| 5,833,490 | A | 11/1998 | Bouldin | |
| 5,850,879 | A | 12/1998 | Smith | |
| 6,086,339 | A | 7/2000 | Jeffrey | |

(Continued)

FOREIGN PATENT DOCUMENTS

| | | | |
|---|---|---|---|
| WO | 03001023 | A1 | 1/2003 |
| WO | 2004067901 | A1 | 8/2004 |
| WO | 2008027047 | A1 | 3/2008 |

OTHER PUBLICATIONS

International Application No. PCT/1B2009/006535 Search Report and Written Opinion dated Mar. 9, 2010.

(Continued)

*Primary Examiner* — Cathleen Hutchins
(74) *Attorney, Agent, or Firm* — Conley Rose, P.C.

(57) ABSTRACT

A technique facilitates the conveyance of signals along a drill pipe. A cable system is combined with the drill pipe and attached along the drill pipe to convey signals. The cable system may comprise a conductive cable, a cable retention system, a cable termination, and a cable connector coupled to the conductive cable at the cable termination.

20 Claims, 11 Drawing Sheets

(56) References Cited

U.S. PATENT DOCUMENTS

| | | | | |
|---|---|---|---|---|
| 6,153,830 | A * | 11/2000 | Montena | 174/88 C |
| 6,209,632 | B1 | 4/2001 | Holbert et al. | |
| 6,241,022 | B1 | 6/2001 | Mailand et al. | |
| 6,310,559 | B1 | 10/2001 | Laborde et al. | |
| 6,530,433 | B2 | 3/2003 | Smith et al. | |
| 6,641,434 | B2 | 11/2003 | Boyle et al. | |
| 6,790,081 | B2 * | 9/2004 | Burris et al. | 439/578 |
| 6,843,119 | B2 | 1/2005 | Patey et al. | |
| 6,928,864 | B1 | 8/2005 | Henry et al. | |
| 7,452,007 | B2 | 11/2008 | Hashem et al. | |
| 7,547,077 | B2 | 6/2009 | Melberg et al. | |
| 2001/0012703 | A1 * | 8/2001 | Wurm et al. | 439/32 |
| 2003/0213598 | A1 | 11/2003 | Hughes | |
| 2004/0134652 | A1 | 7/2004 | Holbert et al. | |
| 2005/0070144 | A1 * | 3/2005 | Hall et al. | 439/191 |
| 2006/0124291 | A1 | 6/2006 | Chau | |
| 2006/0205272 | A1 * | 9/2006 | Rodrigues | 439/585 |
| 2007/0010119 | A1 | 1/2007 | Hall et al. | |
| 2009/0139711 | A1 | 6/2009 | Hall et al. | |

OTHER PUBLICATIONS

U.S. Appl. No. 12/264,340 Office Action dated May 14, 2010.
U.S. Appl. No. 12/264,340 Response to Office Action, dated Aug. 9, 2010.
U.S. Appl. No. 12/264,340 Final Office Action dated Aug. 27, 2010.

* cited by examiner

WIRED DRILL PIPE CABLE CONNECTOR SYSTEM

CROSS-REFERENCE TO RELATED APPLICATION

This application is the U.S. National Stage under 35 U.S.C. §371 of International Patent Application No. PCT/IB2009/006535 filed Mar. 25, 2009, which claims the benefit of U.S. Provisional Patent Application No. 61/043,258 filed Apr. 8, 2008.

STATEMENT REGARDING FEDERALLY SPONSORED RESEARCH OR DEVELOPMENT

Not applicable.

BACKGROUND

Wellbores are drilled to locate and produce hydrocarbons. A downhole drilling tool with a bit at one end thereof is advanced into the ground via a drill string to form a wellbore. The drill string and the downhole tool are typically made of a series of drill pipes threadably connected together to form a long tube with the bit at the lower end thereof. As the drilling tool is advanced, a drilling mud is pumped from a surface mud pit, through the drill string and the drilling tool and out the drill bit to cool the drilling tool and carry away cuttings. The fluid exits the drill bit and flows back up to the surface for recirculation through the tool. The drilling mud is also used to form a mudcake to line the wellbore.

During the drilling operation, it is desirable to provide communication between the surface and the downhole tool. Wellbore telemetry devices are typically used to allow, for example, power, command and/or communication signals to pass between a surface unit and the downhole tool. These signals are used to control and/or power the operation of the downhole tool and send downhole information to the surface.

Various wellbore telemetry systems may be used to establish the desired communication capabilities. Examples of such systems may include a wired drill pipe wellbore telemetry system as described in U.S. Pat. No. 6,641,434, an electromagnetic wellbore telemetry system as described in U.S. Pat. No. 5,624,051, an acoustic wellbore telemetry system as described in PCT Patent Application No. WO2004085796, the entire contents of which are hereby incorporated by reference. Other data conveyance or communication devices, such as transceivers coupled to sensors, may also be used to transmit power and/or data.

With wired drill pipe ("WDP") telemetry systems, the drill pipes that form the drill string are provided with electronics capable of passing a signal between a surface unit and the downhole tool. As shown, for example, in U.S. Pat. No. 6,641,434, such wired drill pipe telemetry systems can be provided with wires and inductive couplings that form a communication chain that extends through the drill string. The wired drill pipe is then operatively connected to the downhole tool and a surface unit for communication therewith. The wired drill pipe system is adapted to pass data received from components in the downhole tool to the surface unit and commands generated by the surface unit to the downhole tool. Further documents relating to wired drill pipes and/or inductive couplers in a drill string are as follows: U.S. Pat. No. 4,126,848, U.S. Pat. No. 3,957,118 and U.S. Pat. No. 3,807,502, the publication "Four Different Systems Used for MWD," W. J. McDonald, The Oil and Gas Journal, pages 115-124, Apr. 3, 1978, U.S. Pat. No. 4,605,268, Russian Federation Published Patent Application 2140527, filed Dec. 18, 1997, Russian Federation Published Patent Application 2,040,691, filed Feb. 14, 1992, WO Publication 90/14497A2, U.S. Pat. No. 5,052,941, U.S. Pat. No. 4,806,928, U.S. Pat. No. 4,901,069, U.S. Pat. No. 5,531,592, U.S. Pat. No. 5,278,550, and U.S. Pat. No. 5,971,072.

However, existing systems often suffer from unreliable connections between the signal couplers and the conductors running between the signal couplers. Therefore, there is a need in the art for new methods and mechanisms for securing cables within or adjacent to drill pipe.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention relates to a system and method for conveying signals along drill pipe between desired locations, such as a surface location and a downhole location. According to an embodiment of the system and the method, a signal communication cable system is combined with a drill pipe to convey signals along the drill pipe. As described in greater detail below, unique approaches are provided for holding the cable system in the drill pipe and for inserting/connecting a cable with a cable coupler/connector. The unique approaches include, for example, holding and retaining the cable system, terminating the cable, differentiating the retention and sealing of the conductive elements, grounding the cable, or carrying out other unique aspects of providing a durable signal communication system combined with drill pipe. The cable may comprise a coaxial cable or any other type of cable capable of transmitting a signal.

Figure 1:
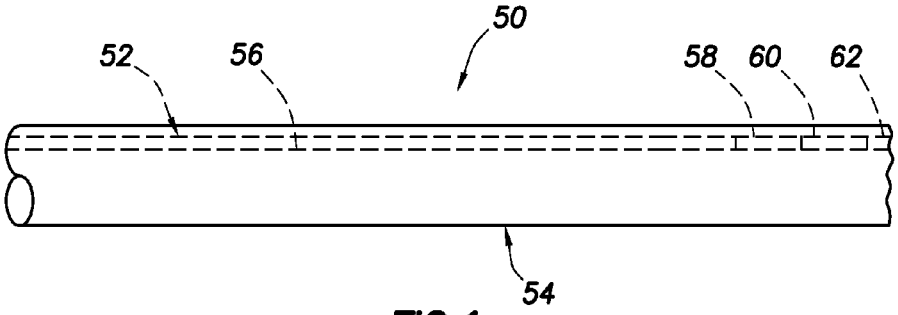
FIG. 1 is a schematic illustration of a drill pipe combined with a cable system, according to an embodiment of the present invention.

Referring generally to FIG. 1, a schematic example of a wired drill pipe system 50 is illustrated. In this embodiment, a cable system 52 for communicating signals is combined with a drill pipe 54. The cable system 52 may comprise a conductive cable 56, e.g. a coaxial cable, routed along drill pipe 54. Additionally, the cable system 52 may comprise a variety of other features, including a cable retention system 58 used to retain cable system 52 at a desired position along drill pipe 54. Cable retention system 58 also may be used to maintain a desired tension in cable 56. The cable system 52 may further comprise a connection or termination section 60 and a connector 62 that is connected to the cable 56 via termination section 60.

Figure 2:
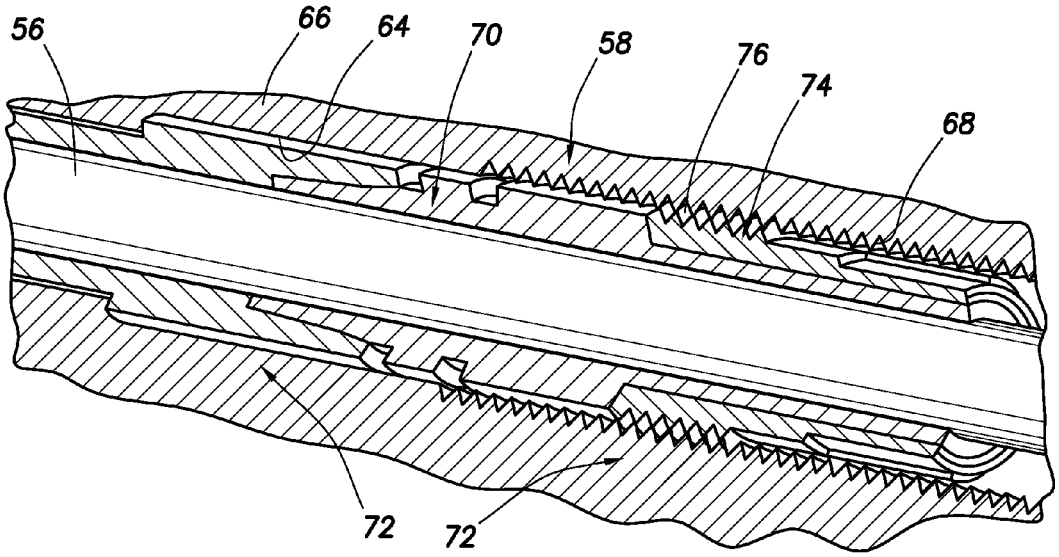
FIG. 2 is an enlarged, partial cross-sectional view of a retention mechanism, according to an embodiment of the present invention.

An embodiment of cable retention system 58 is illustrated in FIG. 2. In this embodiment, the cable retention system 58 is mounted in a bore 64 of a surrounding housing 66. The bore 64 may comprise a threaded section 68, which may extend along a substantial portion of the bore 64. The retention system 58 comprises a ferrule 70, such as a double wedged ferrule, that can hold and secure the cable 56 in compression and/or tension. In the embodiment illustrated, the ferrule 70 has wedges engaged by corresponding seat members 72, which can be energized by the ferrule 70 to secure cable 56. For example, an energizing member 74, such as the illustrated gland nut 74, may be used to energize ferrule 70 and seat members 72 to secure cable 56. Gland nut 74 may have a threaded region 76 that engages threaded section 68 of the surrounding housing 64 to enable axial movement of the gland nut 74 when rotated.

By way of example, the cable retention system 58 can be set when the cable 56 is pulled to a specified load and the gland nut 74 is tightened or otherwise positioned to a specified torque. The tightening of gland nut 74 energizes the ferrule 70 to grip, for example to grip in two positions, via seat members 72, thus securing and holding the cable 56. In this embodiment, the ferrule 70 has edges that are opposite and grip in opposite directions, which allows retention of the cable 56 when the cable 56 is in compression or tension.

Figure 3:
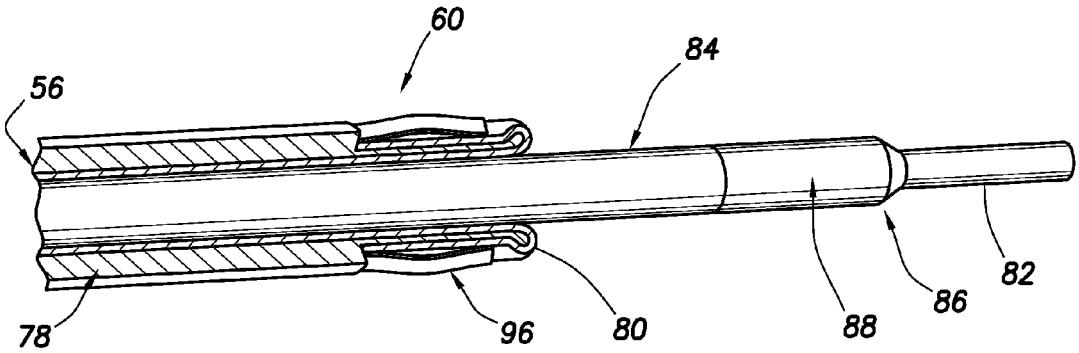
FIG. 3 is an enlarged, partial cross-sectional view of a cable termination section, according to an embodiment of the present invention.

Referring generally to FIG. 3, an example of a portion of termination section 60 is illustrated. The cable termination section enables the cable 56 that may be cut to a desired length and connected with a suitable end connector 62. When the cable 56 is a coaxial cable, for example, an outer layer 78, such as an outer metal armor layer, is removed to expose a radially outlying conductor 80. The conductor 80 may be a conductive element formed as a sheet, such as a sheet of conductive mesh material, which surrounds an internal conductor 82. A layer of insulation material 84 may be positioned to separate the internal conductive element 82 from the radially outlying conductor 80. The outer layer 78 may be removed in a manner that exposes the connector 80 without damaging internal components of the cable 56.

By way of example, the cable 56 may be formed as a welded cable with encapsulated inner layers. In an alternative embodiment, the inner layers are inserted into a seamless tube, and the tube may be drawn to a specified size to encapsulate the inner layers of the cable 56. An extra sleeve also may be used at the end of the outer metal tube, e.g. armor layer 78, to facilitate formation of a proper connection between the outer conductive element 80 and the connector 62.

Figure 4:
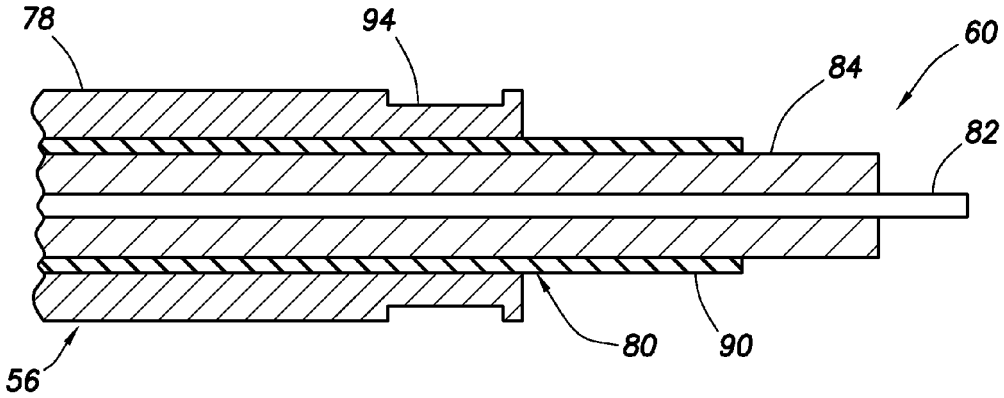
FIG. 4 is a cross-sectional view of one embodiment of a cable end, according to an embodiment of the present invention.
Figure 5:
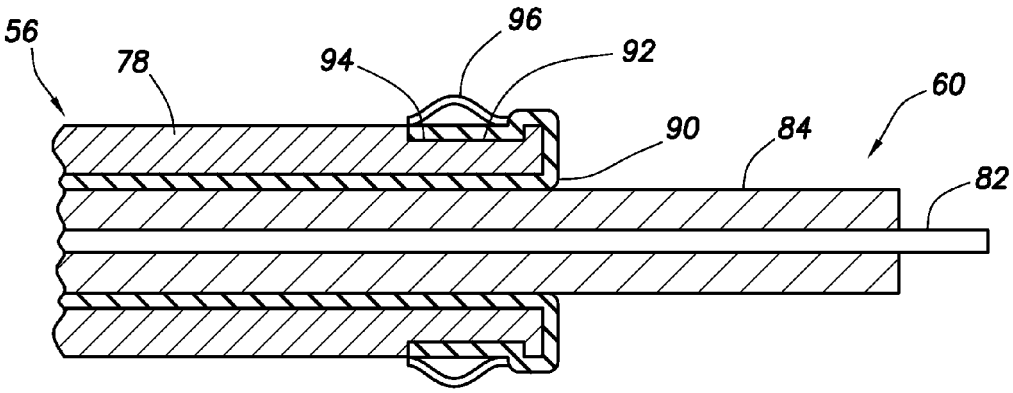
FIG. 5 is another cross-sectional view of one embodiment of a cable end, according to an embodiment of the present invention.

In an example, the internal conductor 82 is prepared for connection with connector 62 by forming the exposed end of the internal conductor as a crimped pin connector 88. As further illustrated in FIGS. 4 and 5, outer conductor 80 may be prepared and/or formed by exposing an end section 90 of conductive element 80 and folding the end section 90 radially outward and over an end feature of a cable layer, such as outer layer 78. Retention of a fold 92 of the end section 90 may be facilitated by forming a groove 94, e.g. an outer annular groove, in the end of cable layer 78, as best illustrated in FIG. 4. The fold 92 may be secured in groove 94 by a conductive retainer 96, e.g. a spring contact band, that can be referred to as an earth contact element. It should be noted that the groove 94 may be formed in the outer metal armor layer (or other layer) by a suitable process, e.g. machining, to terminate the return path provided by outer conductor 80.

Figure 6:
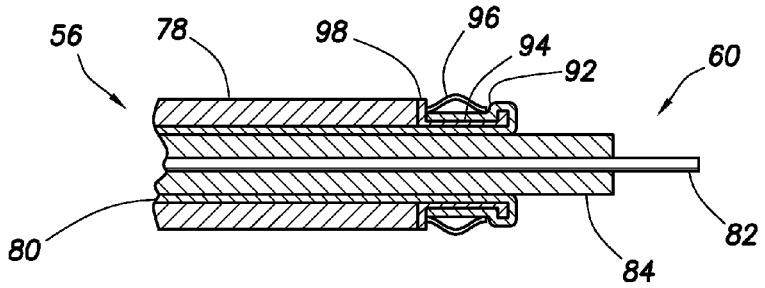
FIG. 6 is another cross-sectional view of one embodiment of a cable end, according to an embodiment of the present invention.
Figure 7:
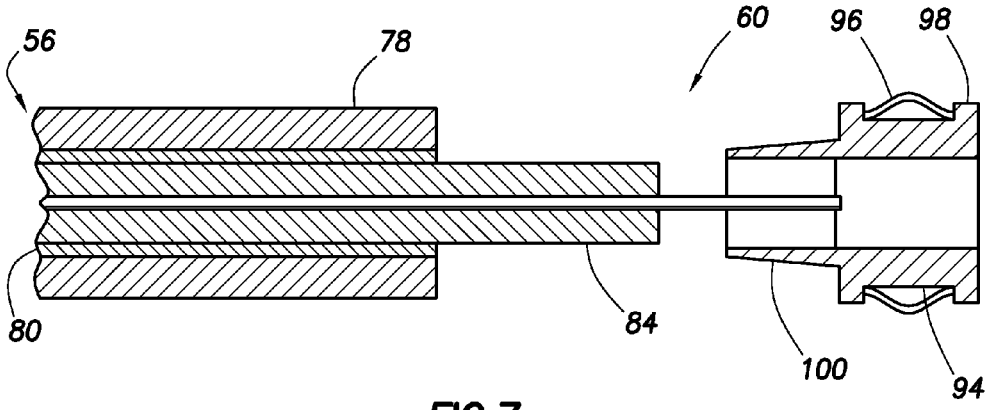
FIG. 7 is another cross-sectional view of one embodiment of a cable end, according to an embodiment of the present invention.
Figure 8:
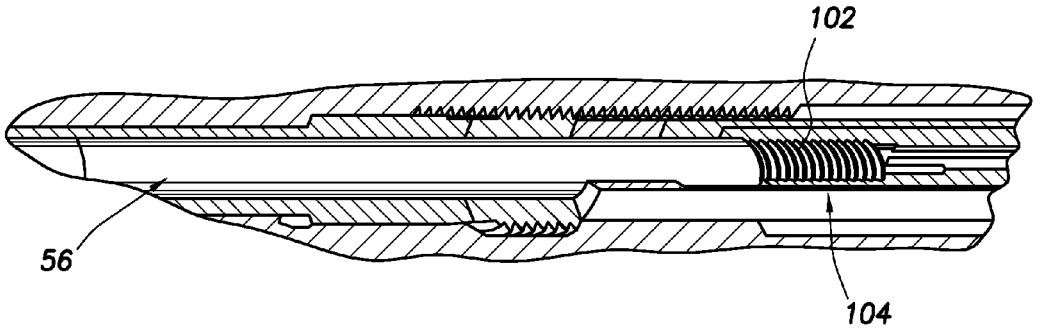
FIG. 8 is a partial, cross-sectional view of one embodiment of a threaded cable end, according to an embodiment of the present invention.

In an alternate embodiment, the end feature of outer cable layer 78 may be formed with a separate component 98, as illustrated in FIG. 6. The separate component 98 may be formed as a sleeve attached to an end of the layer 78 and constructed with the groove 94 or other appropriate gripping features. The separate component 98 may be adhered to or otherwise attached to the end of layer 78. As illustrated in FIG. 7, the component 98 also may be formed as a sleeve with barbed pins 100 oriented for insertion between the layer 78, which may be made of a durable material such as metal, and insulation layer 84. The separate component 98 and/or the end of outer layer 78 may be formed with other features, such as threads 102, as illustrated in FIG. 8. Threads 102 or similar features may be used to attach the cable termination component 98 or to attach a cable puller 104 to facilitate pulling of the cable 56.

Figure 9:
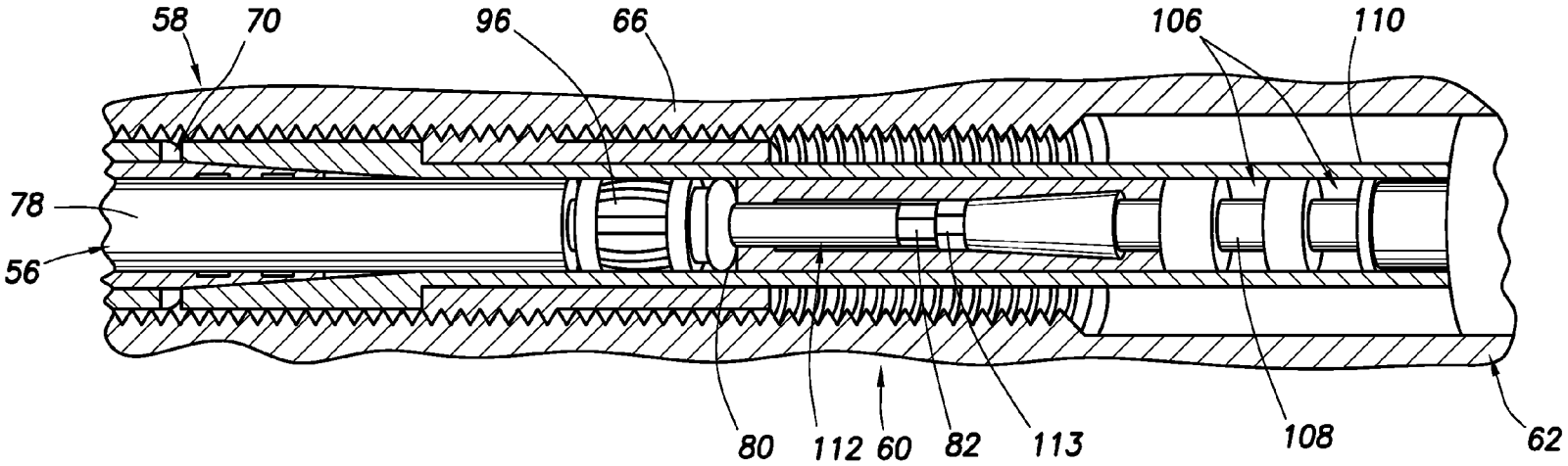
FIG. 9 is a partial cross-sectional view of a cable termination section, according to an embodiment of the present invention.

Referring generally to FIG. 9, termination section 60 is illustrated with the conductive elements 80, 82 of the cable termination engaged with corresponding elements which may be part of connector 62. For example, the conductive element 80 may be an outer conductive element and the conductive element 82 may be an inner conductive element. In this embodiment, the outer conductive element 80 is isolated by a primary seal 106 disposed between a stem portion 108 of connector 62 and a surrounding sleeve housing 110. In this particular example, the opposite side of outer conductive element 80 is isolated and sealed via retention mechanism 58 and the ferrule 70. Accordingly, in this embodiment primary seal 106 may rely on retention mechanism 58 to form a seal and to isolate the conductive elements 80, 82. The inner conductive element 82 and its connection with the connector 62 also may be isolated by employing a secondary seal 112, which may be in the form of a sealing boot or other sealing device. As illustrated, the inner conductive element 82 may conductively engage a corresponding conductive element 113 formed as part of or otherwise connected with the connector 62. Outer conductive element 80 conductively engages sleeve housing 110 to provide an earth return path.

Figure 10:
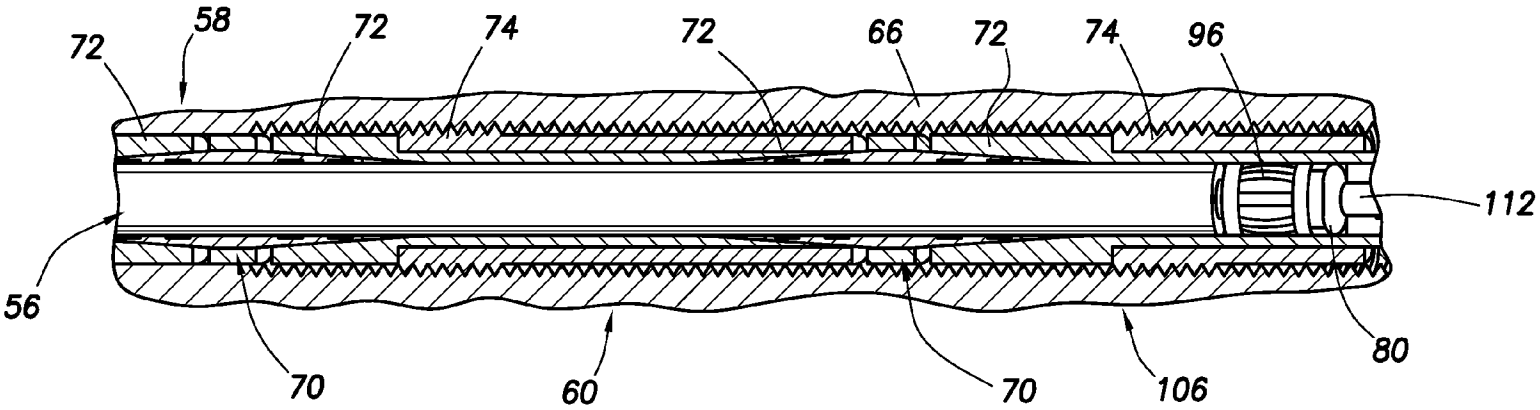
FIG. 10 is another partial cross-sectional view of a cable termination section, according to an embodiment of the present invention.
Figure 11:
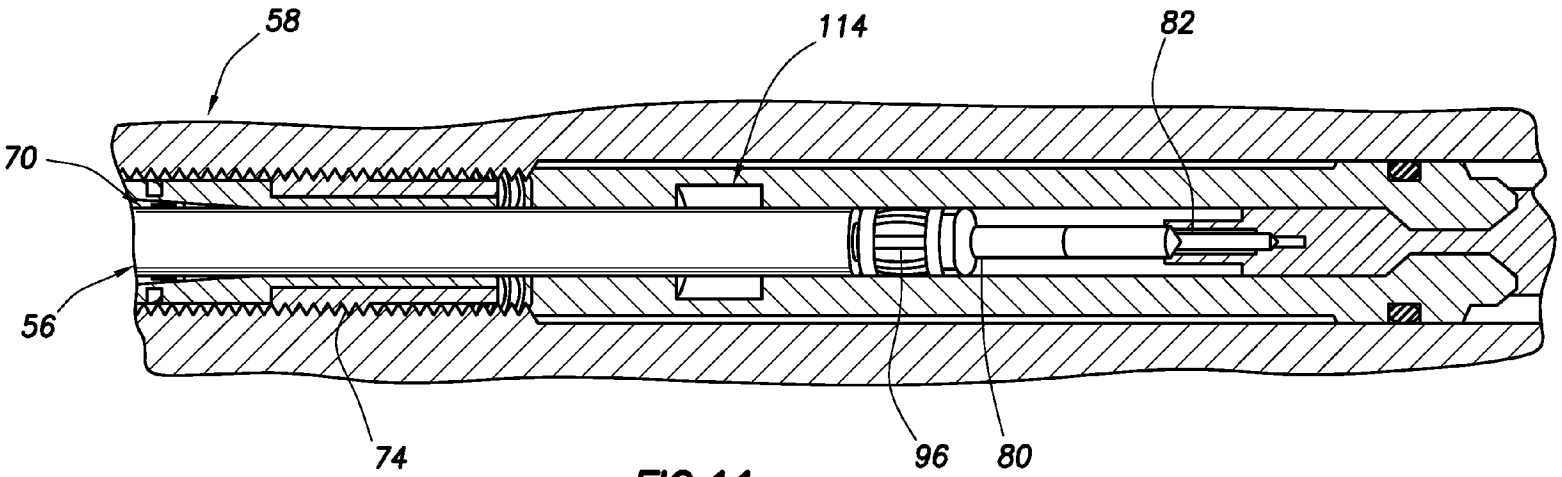
FIG. 11 is another partial cross-sectional view of a cable termination section, according to an embodiment of the present invention.
Figure 12:
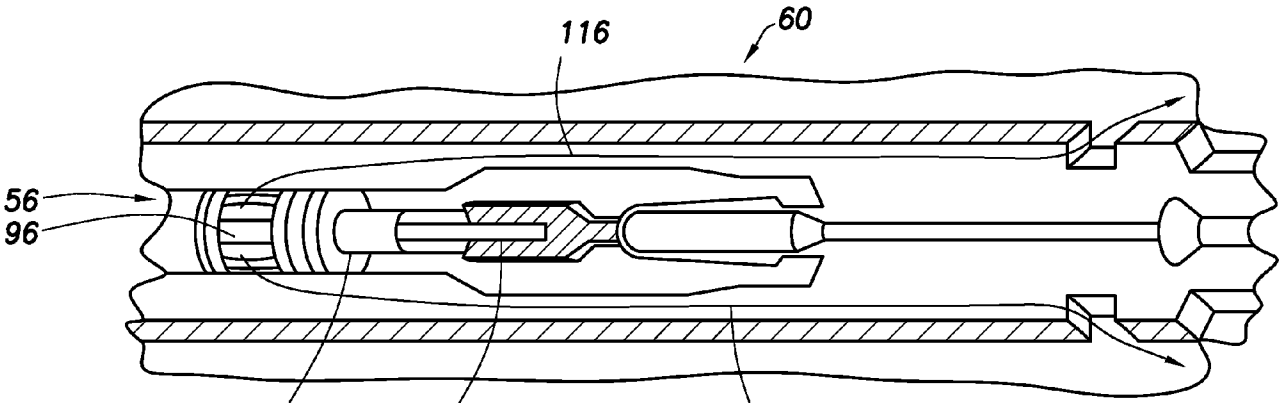
FIG. 12 is another partial cross-sectional view of a cable termination section, according to an embodiment of the present invention.

In an alternate embodiment, the retention mechanism 58 is independent of the primary sealing system 106, as illustrated in FIG. 10. As illustrated, the ferrules 70 of this embodiment consist of a pair of double wedged ferrules, in which one of the ferrules 70 is used to form the retention mechanism 58 and the other one of the ferrules 70 is used to form one side of primary sealing system 106. However, other sealing mechanisms, such as a seal ring 114 illustrated in FIG. 11, can be used to form an independent seal with respect to the retention mechanism 58. By way of example, the ferrule 70 may comprise a metal seal, and the seal ring 114 may comprise an elastomeric seal. Preparation of proper seals ensures maintenance of desired conductive flow paths. As illustrated in FIG. 12, for example, formation of a dependable ground path can be created with respect to outer conductor 80, as represented by arrows 116. In some applications, grounding can be improved by minimizing the electrical path, by using highly conductive materials, such as superconductor materials, and by directing the current return path along parts that may be accurately controlled and machined.

The various components used to create the retention system 58, the termination section 60, and the connector 62 may vary depending on the application, environment, and desired performance. For example, cable clamping and sealing glands may be designed with a shallow compression angle, e.g. 3°, to provide a taper locking seal so that if the gland nut 74 becomes dislodged under the effects of vibration, the cable seals remain intact. However, larger cone angles also may be used with some types of seals, including ferrule seals.

The outer armor layer or jacket 78 can be formed from a variety of materials including nickel alloys, such as inconel 825. Another suitable material includes stainless steel 316L. The compression ferrules 70 may be formed from a softer material compared to the materials used to form the compression seat members 72. Examples include Hastelloy C276 and stainless steel 316L, depending on well conditions and chemicals used. Components such as cable sealing seats, compression sleeves, and gland nuts can be made from a high strength material, such as inconel 718 or K500 monel. To prevent galling and thread pickup, the gland nuts 74 may be coated with a low friction coating of ptfe impregnated nickel in an electro-plating process.

The earth contact component 98 may be formed from a metal or metal alloy, for example, gold plated brass or a copper alloy tube over which the end section 90 of conductive element 80 is folded. In some applications, conductive element 80 is formed from an earth screen braid that may be furled over component 98 and secured by conductive retainer 96. Retainer 96 may be in the form of a gold plated beryllium copper louvered contact band element. The inner conductive element 82 may be sealed by elastomeric boot 112 which may be formed from HNBR or perflouroelastomer material, for example, that may be stretch fit over the cable insulation material.

The end connector 62 may be constructed as a feed through element formed of insulation material resistant to high pressures and temperatures. For example, the connector may be formed from injection moldable materials, including polyetheretherketone (PEEK) molded around a contact which may be formed of a conductive material, such as gold plated beryllium copper or inconel X750. These are just a few examples of materials and constructions that can be used to form components of cable system 52, and a person having ordinary skill in the art will appreciate that other materials may be utilized.

Figure 13:
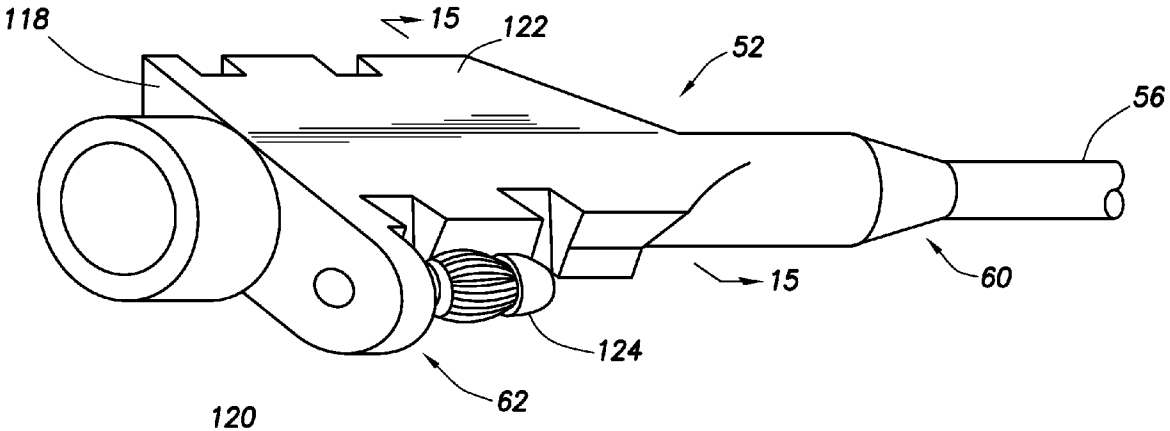
FIG. 13 is an orthogonal view of one embodiment of a cable connector/coupler, according to an embodiment of the present invention.
Figure 14:
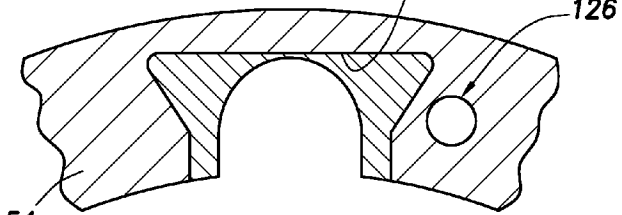
FIG. 14 is an end view of a portion of a drill pipe having a cavity for receiving the cable connector illustrated in FIG. 13, according to an embodiment of the present invention.
Figure 15:
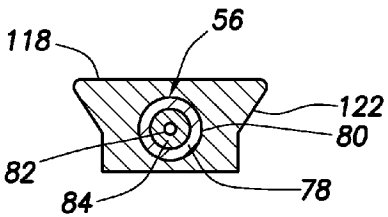
FIG. 15 is a cross-sectional view taken generally along line 15-15 of FIG. 13, according to an embodiment of the present invention.

Referring generally to FIG. 13, another embodiment of cable system 52 is illustrated. In this embodiment, the connector 62 is connected to the conductive cable 56, e.g. a coaxial cable, via the termination section 60. The connector 62 comprises a cable head 118 shaped for receipt in a corresponding recess or cavity 120 formed in drill pipe 54, as illustrated in FIG. 14. Although recess 120 may have a variety of shapes configured to hold a cable head 118, one embodiment is designed to receive cable head 118 formed with a dovetail section 122 having a dovetail shape as better illustrated in the cross-sectional view of FIG. 15.

Figure 16:
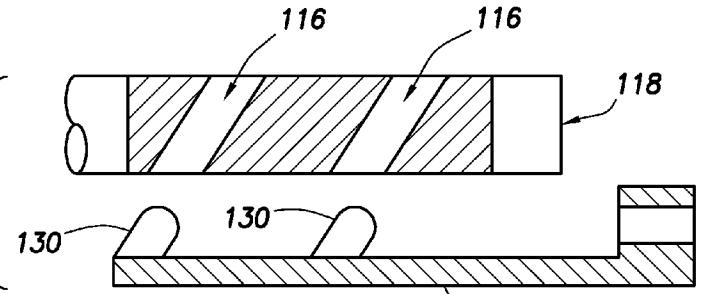
FIG. 16 is a partial side view of the cable connector adjacent to a tool, according to an embodiment of the present invention.

As further illustrated in FIG. 13, the cable head 118 may comprise a contact pin 124 that may be an earth contact pin conductively connected with outer conductive element 80. In the example illustrated, the contact pin 124 may be radially offset from an axis of cable 56 and oriented for receipt in a corresponding opening 126. Additionally, cable head 118 may comprise a plurality of engagement features 128, as further illustrated in FIG. 16, to enable the cable system to be pulled or stretched. By way of example, engagement features 128 may comprise angled recesses oriented to engage corresponding protrusions 130 of a pull-in tool 132.

Figure 17:
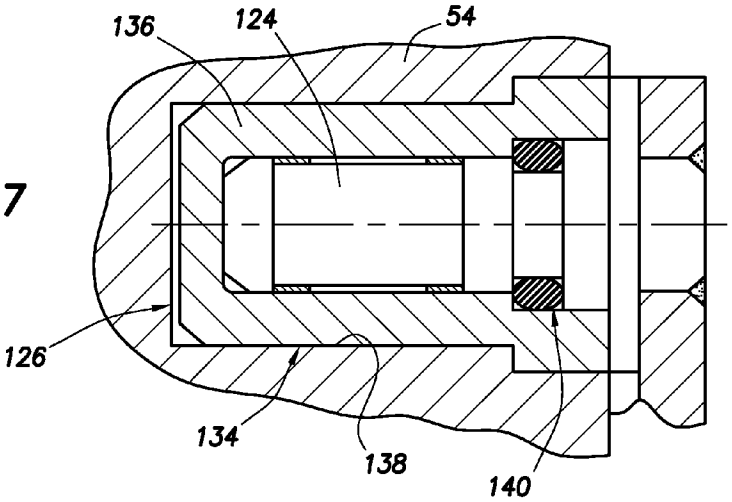
FIG. 17 is a cross-sectional view of a contact pin of the coupler illustrated in FIG. 13 but inserted into a corresponding cavity of the drill pipe, according to an embodiment of the present invention.

In FIG. 17, an example of the contact pin 124 inserted in the corresponding opening 126 is illustrated. In this embodiment, the contact pin 124 includes a conductive contact band 134 which facilitates formation of a sealed earth contact to the drill pipe material. In one example, opening 126 is lined with a blind sleeve 136 which is driven into an aperture 138 formed in the material of drill pipe 54. The joint formed between the contact pin 124 and the opening 126 may be sealed with a fluorocarbon based sealant and an elastomeric seal ring 140, for example, or may be otherwise sealed.

Figure 18:
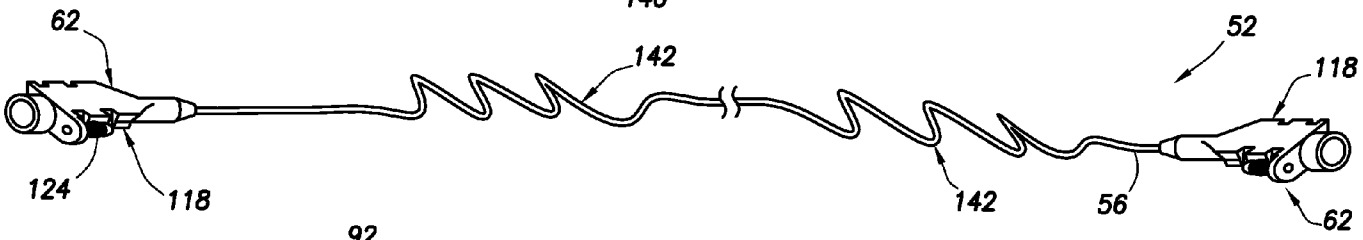
FIG. 18 is a view of the cable system having a cable between two end connectors, according to an embodiment of the present invention.

In some embodiments, cable system 52 can be formed with a plurality of snake bends 142 in cable 56 to allow for pipe variability, as illustrated in FIG. 18. For example, the cable system 52 may be installed through the center of a corresponding drill pipe 54 by seating one cable head 118 in its corresponding recess 120. The other cable head 118 can then be engaged by a suitable tool, such as pull-in tool 132, and stretched before being allowed to spring back into engagement with its corresponding recess 120.

Figure 19:
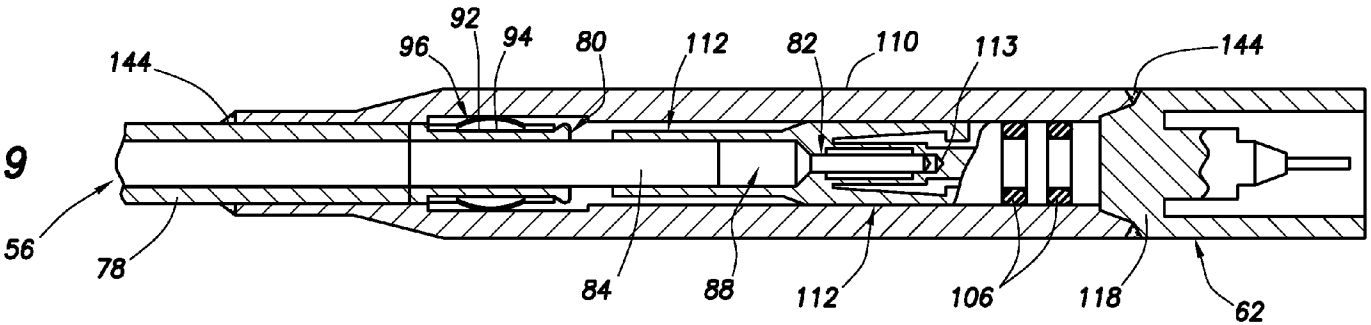
FIG. 19 is a cross-sectional view of a termination section joining a connector and a cable, according to an embodiment of the present invention.

As illustrated in FIG. 19, this type of connector 62 may be connected to conductive, e.g. coaxial, cable 56 through a termination section similar to that described above with respect to FIGS. 2-12. In some embodiments, however, the various weld joints, e.g. weld joints 144, can be formed using TIG welding by an automatic orbital welding machine or by manual welding. Alternatively, an electron beam or laser weld can be performed. In FIG. 19, a crimped pin connector 88 is illustrated, however a variety of other contacts can be utilized, including coupler type contacts, conductive contacts, inductive contacts, transformer contacts, or other suitable contacts. Additionally, sleeve housing 110 is illustrated as surrounding the various termination section components, however a variety of other housings, including the surrounding drill pipe material, may be utilized.

Figure 20:
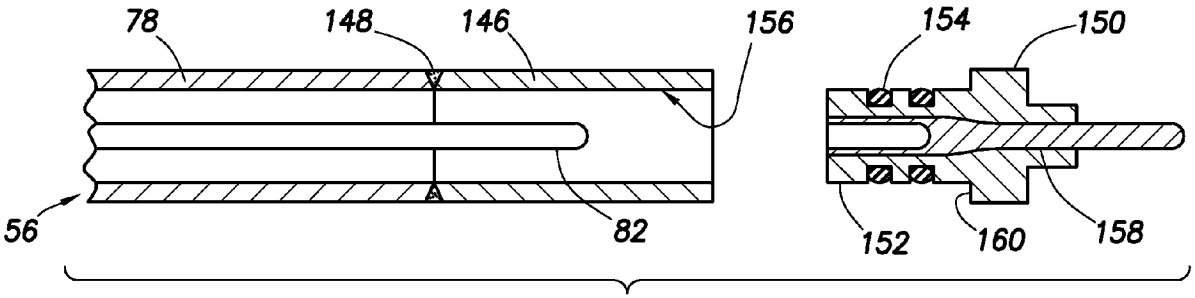
FIG. 20 is a schematic illustration of a cable termination section, according to an embodiment of the present invention.

Depending on the design and environmental requirements, the termination section 60 may comprise many types of termination components. For example, the termination of conductive, coaxial cable 56 can be constructed in various configurations with various components. Referring to the embodiment of FIG. 20, for example, the length of the tubular cable can be adjusted by attaching a tube extension or tube interface 146 to the end of outer cable layer 78. In this embodiment, the tube interface 146 may be attached to cable layer 78 via a weld 148. The tube interface 146 enables internal sealing with an adapter 150 having an insert 152 sized for insertion into tube interface 146. Seal members 154 can be used to form a fluid tight seal with an internal seal surface 156 of the tube interface 146. Adapter 150 further comprises an internal conductor 158 that is engagable with internal conductive element 82 when the adapter 150 is inserted into or otherwise positioned at the tube interface 146 until contact occurs with abutment 160. In this example, the tube interface 146 enables use of standard length conductive tubes 56, and the overall length of the cable system 52 may be adjusted by changing the length of tube interface 146

Figure 21:
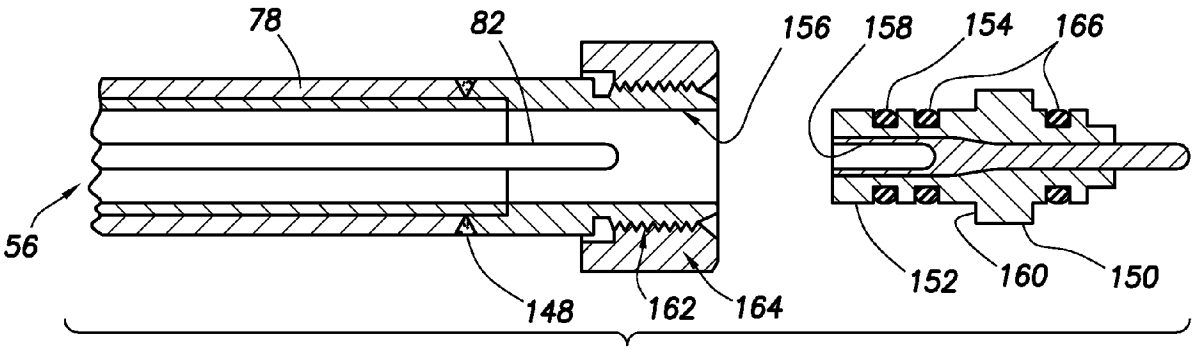
FIG. 21 is a schematic illustration of another cable termination section, according to an embodiment of the present invention.
Figure 22:
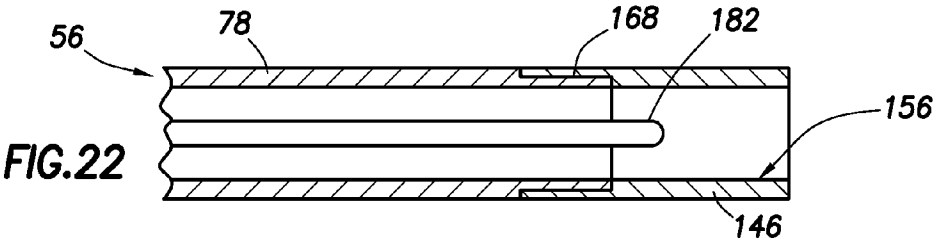
FIG. 22 is a schematic illustration of another cable termination section, according to an embodiment of the present invention.

A similar embodiment is illustrated in FIG. 21. In this embodiment, the tube interface 146 comprises a threaded region 162 engaged by a locking nut 164 which helps retain the tube interface 146 in a surrounding housing. Additionally, adapter 150 may comprise one or more ground contact members 166 to ensure grounding. In a related embodiment, tube interface 146 is press fit onto cable layer 78 via a press fit region 168, as illustrated in FIG. 22.

Figure 23:
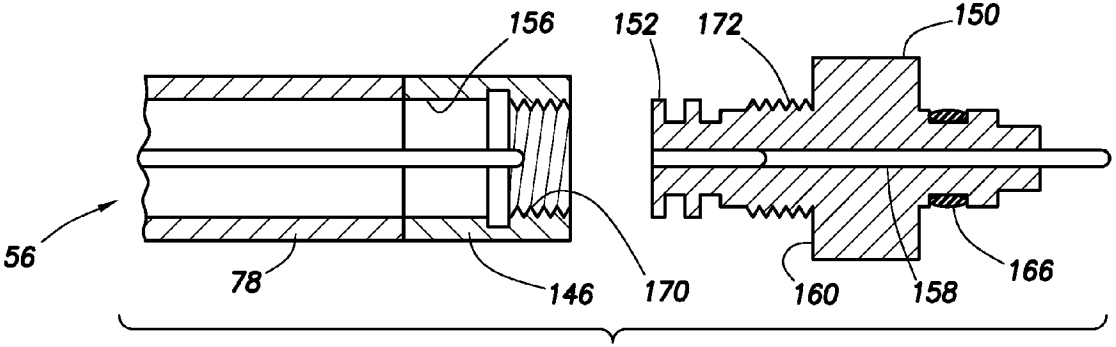
FIG. 23 is a schematic illustration of another cable termination section, according to an embodiment of the present invention.
Figure 24:
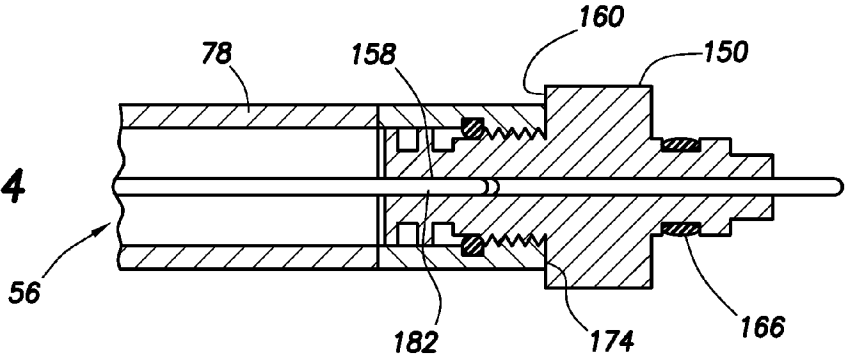
FIG. 24 is a schematic illustration of another cable termination section, according to an embodiment of the present invention.
Figure 25:
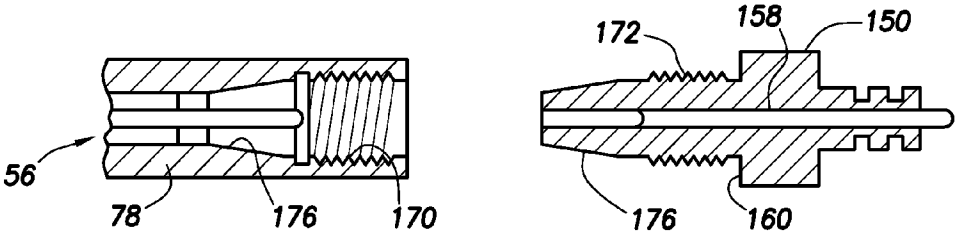
FIG. 25 is a schematic illustration of another cable termination section, according to an embodiment of the present invention.

Referring generally to FIG. 23, another embodiment is illustrated in which the tube interface 146 comprises both internal seal surface 156 and an internal threaded region 170. Adapter 150 comprises a corresponding, external threaded region 172 to enable sealing, threaded engagement between tube interface 146 and adapter 150, as best illustrated in FIG. 24. Alternatively, the threaded region 170 may be disposed along and exterior of the tube interface 146 for engagement by an internally threaded sleeve of the adapter 150. The adapter 150 may be threaded into or otherwise positioned within the tube/layer 78 until the adapter 150 abuts against a shoulder 174, which allows tension to be applied to conductive cable 56, thus locking the cable into position. In another embodiment, the cooperating threaded regions 170, 172 enable use of tapered metal-to-metal seal members 176 to form a seal between cable layer 78 and adapter 150, as illustrated in FIG. 25.

Figure 26:
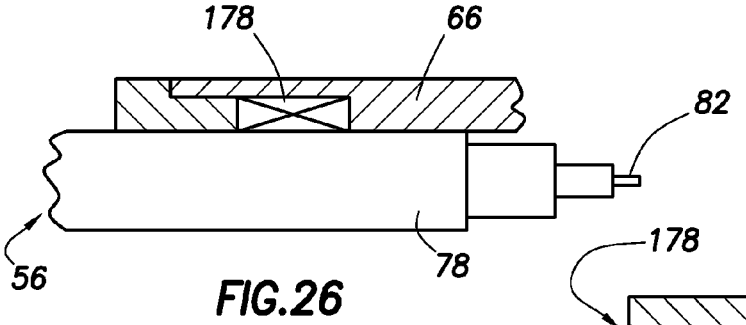
FIG. 26 is a schematic illustration of a sealing system for forming a seal between the cable and the surrounding housing, according to an embodiment of the present invention.

As described above, seals can be used between the cable 56 and the surrounding housing in a given embodiment. Depending on the design and environment, the type of seal structure may vary from one embodiment to another. In FIG. 26, a seal structure 178 is illustrated and may be used to form, for example, primary seal 106. In this example, seal structure 178 is positioned directly between conductive cable 56 and the surrounding housing, e.g. sleeve housing 110. The seal structure may comprise a variety of seals, including an O-ring seal, a chevron seal, a T-seal, a swage (ferrule) seal, a conical metal-to-metal seal or another suitable seal.

Figure 27:
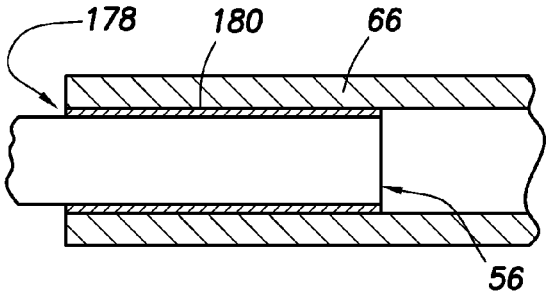
FIG. 27 is a schematic illustration of another sealing system, according to an embodiment of the present invention.
Figure 28:
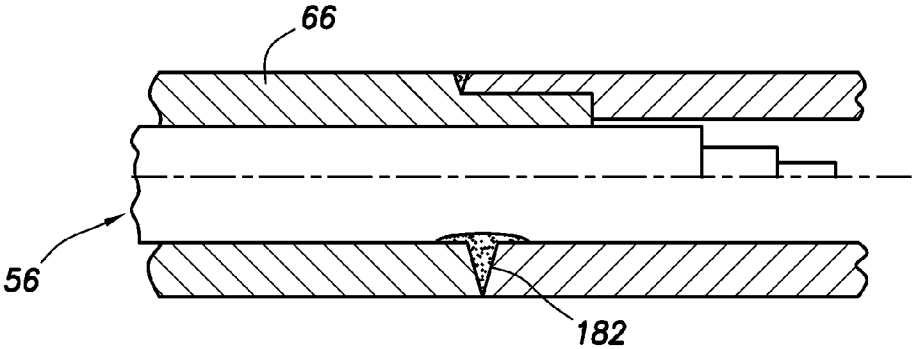
FIG. 28 is a schematic illustration of another sealing system, according to an embodiment of the present invention.

In another embodiment, the seal structure 178 comprises a mechanical interference layer 180 positioned between the cable 56 and the surrounding housing, as illustrated in FIG. 27. By way of example, the mechanical interference layer may be formed from a variety of materials including teflon, plastic or other elastomeric materials. In another embodiment, the surrounding housing is fit tightly against the outer metal layer 78 of cable 56 and sealed thereto with one or more welds 182, as illustrated in FIG. 28.

Figure 29:
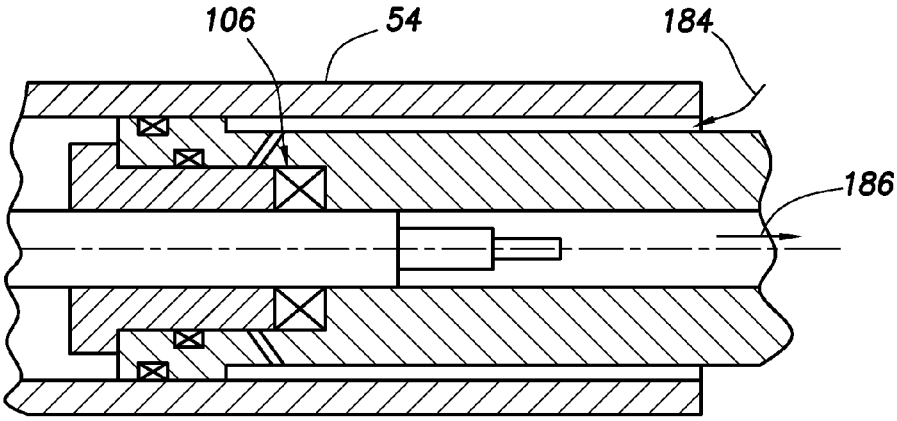
FIG. 29 is a schematic illustration of the sealing system being tested, according to an embodiment of the present invention.

Referring to FIG. 29, formation of a suitable seal via seal structure 178 may be tested by applying pressure as represented by arrow 184. Pressure represented by the arrow 184 is directed between the drill pipe 54 and the termination section 60 to determine whether any fluid flows, as represented by arrow 186, can be detected. If fluid is detected as passing through the termination section, the seal under test is not operating properly. A variety of test equipment and test procedures can be used to ensure suitable seals are formed between the cable system 52 and the drill pipe 54 and/or between other components of cable system 52.

Figure 30:
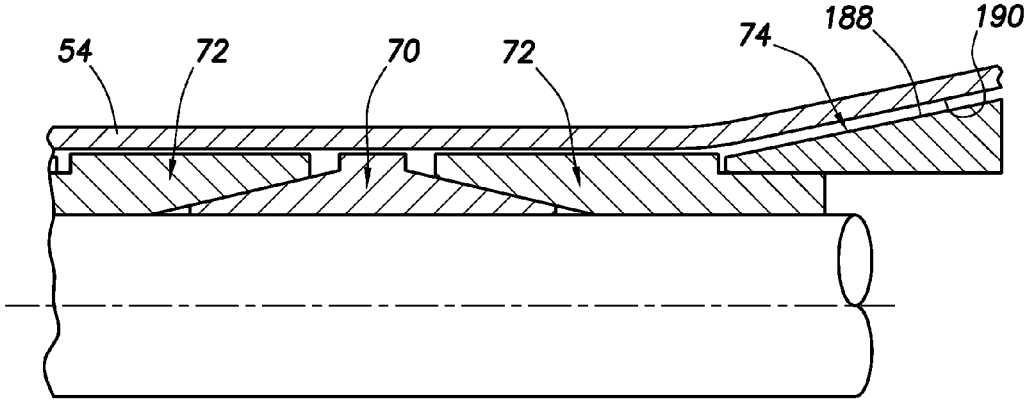
FIG. 30 is a schematic illustration of one example of a cable retention system, according to an embodiment of the present invention.
Figure 31:
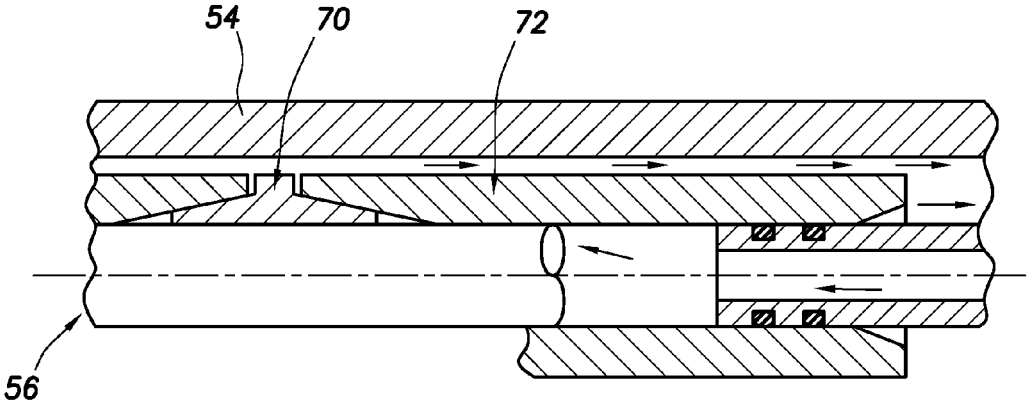
FIG. 31 is a schematic illustration of another example of a cable retention system, according to an embodiment of the present invention.

Additionally, a variety of energizing devices 74 other than the gland nut discussed above can be used to energize mechanisms for retaining and/or sealing the cable system 52 along the drill pipe 54. As illustrated in FIG. 30, for example, the energizing device 74 may comprise a swage 188 mounted in a corresponding, tapered cavity 190 of drill pipe 54. Movement of swage 188 against one of the seat members 72 drives the seat member against ferrule 70 which, again, causes both seat members 72 to move outwardly against the surrounding housing, which in this example is drill pipe 54. In some applications, no separate energizing member 74 is required, and seat member 72 can simply be jammed against ferrule 70 before testing for leaks, as illustrated in FIG. 31.

Figure 32:
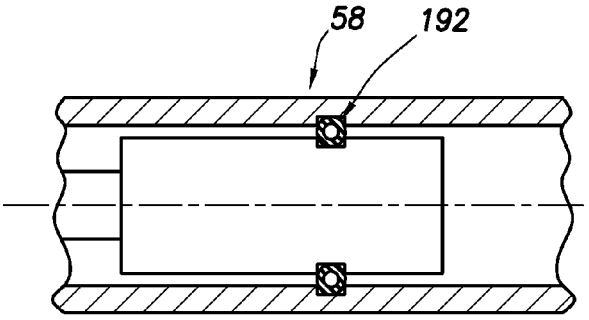
FIG. 32 is a schematic illustration of another example of a cable retention system, according to an embodiment of the present invention.

If primarily retention is desired, a variety of retention mechanisms may be used in cable retention system 58. As illustrated in FIG. 32, for example, a retention device 192 can be used to secure cable system 52 within the surrounding housing, e.g. drill pipe 54. By way of example, retention device 192 may comprise a gater spring, a weldment, a brazed region, or various other retaining mechanisms.

The various embodiments described above provide a simplified construction that enables easy installation of cable system 52 into drill pipe 54. The overall system is fully hydrostatically and electrically testable outside of the drill pipe. Several embodiments enable a welded construction and/or a construction that can be retrofitted in the field. Furthermore, the wired drill pipe system lowers transport and logistical costs, while enabling installation by unskilled personnel.

The parameters of a given drilling application and/or drilling environment may dictate construction of the wired drill pipe system with a variety of different components and configurations. For example, different types of seals, weldments, retention mechanisms, energizing systems, cable termination systems and adapters, and drill pipe can be employed to achieve the desired design characteristics. Furthermore, the various components described herein can be formed from a variety of materials. In some applications, certain components may be formed from metal materials, while other applications allow those components to be formed from elastomeric materials.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A system for use in a well, comprising:

a drill pipe; and a cable system attached along the drill pipe, the cable system comprising:

a cable;

a cable retention system disposed radially between the cable and a wall of the drill pipe to retain the cable along the drill pipe;

a cable termination section having an internal conductive contact and a radially outward contact formed with an outer conductive layer folded back over an outer cable layer; and a cable connector disposed within the wall of the drill pipe and coupled to the cable at the cable termination section.

2. The system of claim 1, wherein the cable retention system comprises a double wedged ferrule energized by an energizing member to retain the cable at a desired location along the drill pipe.

3. The system of claim 2, wherein the cable retention system further comprises a seal positioned to seal the cable with respect to a surrounding housing.

4. The system of claim 1, wherein the cable termination section comprises a groove formed at an end of the cable to receive a fold of the outer conductive layer.

5. The system of claim 4, wherein the cable termination further comprises a spring contact band positioned over the fold to secure the fold in the groove.

6. The system of claim 1, wherein the cable termination section comprises an adapter engaged with a cable end.

7. The system of claim 1, wherein the cable connector comprises an offset earth contact pin positioned for receipt in a corresponding opening in the drill pipe.

8. A method of forming a wired drill pipe, comprising:

terminating a coaxial cable to create a termination section;

attaching a connector to the termination section to form a conductive connection along both an inner conductor and a radially outer conductor;

sealing the termination section with a primary seal disposed between the inner conductor and the radially outer conductor and a secondary seal isolating the inner conductor; and retaining the coaxial cable with a desired amount of tension via a retention mechanism located along a drill pipe.

9. The method of claim 8, further comprising positioning the retention system at a location independent of the primary seal.

10. The method of claim 8, wherein attaching comprises forming a groove in an end of an outer layer of the coaxial cable and folding a portion of the radially outer conductor into the groove.

11. The method of claim 10, further comprising grounding the portion to a surrounding housing.

12. The method of claim 8, further comprising forming the connector with a specific shape to enable retention of the connector in a recess of the drill pipe having a corresponding shape.

13. The method of claim 12, wherein forming further comprises forming the connector with an earth contact pin offset from an axis of the coaxial cable.

14. The method of claim 8, further comprising forming the connector with a feature positioned to engage a pull-in tool.

15. A cable connection for use in combination with a drill pipe, comprising:

a coaxial cable;

a connector coupled to the coaxial cable at a termination section, the termination section comprising an outer housing; an internal conductive contact; a radially outward conductive contact; a seal system to isolate the internal conductive contact and the radially outward conductive contact; and a retention mechanism disposed within a wall of the drill pipe and radially between the coaxial cable and the wall of the drill pipe, wherein the retention mechanism is configured to retain the coaxial cable at a desired position with respect to the drill pipe.

16. The cable connection of claim 15, wherein the internal conductive contact comprises a crimped pin connector.

17. The cable connection of claim 15, wherein the radially outward conductive contact comprises an outer conductive layer of the coaxial cable folded radially outward and over a grooved cable end feature.

18. The cable connection of claim 15, wherein the seal system comprises a primary seal to protect the radially outward conductive contact and a secondary seal to protect the internal conductive contact.

19. The cable connection of claim 15, wherein the retention mechanism comprises a wedged ferrule.

20. The cable connection of claim 15, wherein the connector comprises a connector head shaped for receipt in a corresponding drill pipe recess.

* * * * *

UNITED STATES PATENT AND TRADEMARK OFFICE

CERTIFICATE OF CORRECTION

PATENT NO. : 8,662,188 B2
APPLICATION NO. : 12/936667
DATED : March 4, 2014
INVENTOR(S) : Chaize et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 549 days.

Signed and Sealed this
Twenty-ninth Day of September, 2015

Michelle K. Lee

Michelle K. Lee
*Director of the United States Patent and Trademark Office*